United States Patent [19]

Lapointe

[11] 4,247,053

[45] Jan. 27, 1981

[54] CHIPPER WITH MEANS FOR SEPARATING DEBRIS FROM CHIPS

[75] Inventor: Joseph A. Lapointe, Pointe Claire, Canada

[73] Assignee: Domtar Inc., Montreal, Canada

[21] Appl. No.: 83,452

[22] Filed: Oct. 10, 1979

Related U.S. Application Data

[63] Continuation-in-part of Ser. No. 949,870, Oct. 10, 1978, abandoned.

[51] Int. Cl.[3] ..... B02C 16/08

[52] U.S. Cl. ..... 241/57; 144/176; 241/92

[58] Field of Search ..... 144/176; 241/47, 56, 241/57, 58, 92, 278 R

[56] References Cited

U.S. PATENT DOCUMENTS

| | | | |
|---|---|---|---|
| 3,346,027 | 10/1967 | Kirsten | 144/176 |
| 3,866,843 | 2/1975 | Lunn | 241/92 X |
| 3,905,558 | 9/1975 | Gaitten | 241/92 X |

FOREIGN PATENT DOCUMENTS

| | | | |
|---|---|---|---|
| 1029284 | 4/1978 | Canada | 241/57 |

*Primary Examiner*—Mark Rosenbaum

*Attorney, Agent, or Firm*—C. A. Rowley

[57] ABSTRACT

A debris separating chipper having a rotor with a cutting face and at least one knife mounted on the cutting face, a housing enclosing said rotor, a debris chamber in said housing having one wall thereof formed by said cutting face, a slot through said cutting face into a space, means for feeding logs to said cutting face, means for directing chips cut by said knife into said space, means for ejecting air out from said slot into said debris chamber, a debris outlet from said chipper for ejecting debris from said debris chamber and a separate chip outlet from said chipper adapted to communicate with said space for ejection of chips from said chipper. The air flow may be in some curves directed as a curtain across the slot to effect a further separation by deflecting lighter materials out of their normal trajectory into a dust chamber that empties into the debris chamber.

9 Claims, 10 Drawing Figures

CHIPPER WITH MEANS FOR SEPARATING DEBRIS FROM CHIPS

This application is a continuation-in-part of application Ser. No. 949,870, filed Oct. 10, 1978, now abandoned.

FIELD OF THE INVENTION

The present invention relates to a wood chipper more specifically the present invention relates to an improved wood chipper for separating debris from chips during the chipping operation.

PRIOR ART

Applicant's previously filed Canadian Pat. No. 1,029,284 issued Apr. 11, 1978 discloses a debris separating chipper comprising of a rotor having a cutting face that forms one wall of a front or debris chamber which has a debris outlet. Chips cut by the knives on the rotor are conveyed away from the front chamber into a chip space or chamber and are rejected from the chipper through a separate chip outlet whereby chips and debris are separated and are ejected from the chipper in separate streams through their respective outlets.

Conventional disc type chippers are provided with impellor blades at the back of the disc which draw air through the back wall of the housing into the chip chamber and blow it out with the chips through the chip outlet. The pumping effect created by these blades also draws air in through the knife slots (the slots leading each knife and through which the chips pass after they are cut) and this drawn through the knife slots entrains small debris particles including grit leaves needles loose bark etc. into the chip chamber where they remix with the chips.

It has also been proposed to provide chip pockets on the rear face of the disc to receive chips cut by the chipper knives and prevent them from hitting the rear face of the chipper housing (see for example Canadian Pat. No. 962,921 issued Feb. 18/75 to Gaitten). These pockets hold the chips until the chip outlet is reached and then ejects them directly into the chip outlet. These chip pockets, by preventing impact of the cuts chips against the rear face of the housing, reduce chip damage during the chipping operation.

It has also been proposed in an earlier Canadian Pat. No. 759,747 issued May 30, 1967 to Kirston to provide chip pockets, to open the pockets to the atmosphere and to provide a volute housing whereby air is pumped through the pockets as the disc rotates. It will be apparent that any air entering the pocket will tend to enter adjacent axes of rotation and be ejected tangentially from the periphery.

BRIEF DESCRIPTION OF THE INVENTION

The present invention provides an improvement over the separator disc chipper described in Canadian Pat. No. 1,029,284 referred to hereinabove by providing air flow through the chip slot into the front or debris chamber and thereby significantly reducing the possibility of entrainment of light material through the chip slot and in some cases to actually blow material away from the slot so that it cannot pass through the slots into the accepted chip area. It is also possible under certain operating conditions to traverse the chip path with a jet of air to deflect and thereby separate light material passing with the chips and reject this material with the debris.

Broadly, the present invention relates to a chipper comprising a housing, a disc mounted for rotation in said housing, said disc having a cutting face, at least one knife on said cutting face, a debris chamber formed between said cutting face and said housing, a slot through said cutting face for passage of chips cut by said knife to a chip space separated from said debris chamber, a debris outlet from said debris chamber for ejecting debris from said chipper, and a separate chip outlet communicating with said space for removel of chips from said chipper, the improvement comprising a compartment on said rotor communicating with said slot, means for connecting said compartment to a means for providing air under pressure so as to eject air from said compartment through said slot towards said debris chamber, whereby air flows through said slot into said debris chamber during at least a substantial portion of the revolution of said disc.

BRIEF DESCRIPTION OF THE DRAWINGS

Further features, objects and advantages will be evident in the following detailed description of the preferred embodiments of the present invention taken in conjunction with the accompanying drawings in which;

Referring to FIGS. 1 & 2 the chipper is formed of housing 10 having a peripheral wall 12, a front wall and a rear wall 16. A chipper disc 18 is rotably mounted within the housing on a suitable shaft 20 and divides the housing 10 into a front or debris chamber 22 and a rear chamber 24. An internal annular partition wall 23 combines with the disc 18 to isolate the front and rear chambers 22 and 24 so that substantially the only communication between the two is through the knife slots 36 as will be described hereinbelow. A tangential outlet 26 is provided adjacent a front wall 14 in communication with the front chamber 22 and functions as a debris outlet for debris entering the front chamber 22. A tangential chip outlet 28 communicates with a rear chamber 24 and provides an outlet for chips cut by the chipper.

Figure 1:
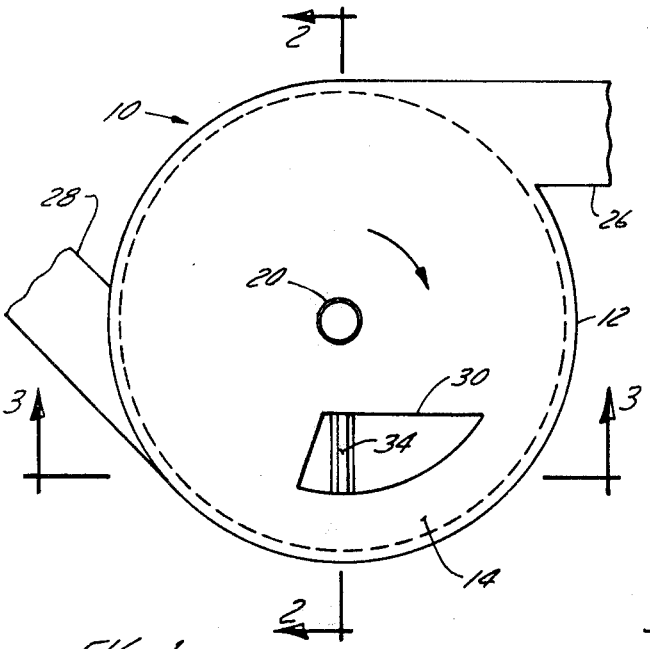
FIG. 1 is a schematic elevation view of a chipper constructed in accordance with the present invention.

A feed inlet 30 is provided through the front wall 14 for feeding logs to the chipper disc 18.

The chipper disc 18 has a front cutting face 32 mounting at least one knife 34. In the illustrated arrangements a knife slot 36 extends through the disc 18 to the backface 38 thereof and is positioned immediately adjacent and in front of each knife 34 so that chips cut by the knife 34 may pass through the disc 18 via the passage 36.

Figure 3:
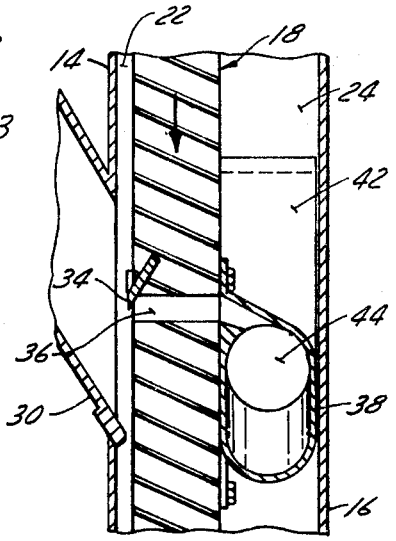
FIG. 3 and 4 are sections along line 3—3 of FIG. 1, illustrating two modifications incorporating the present invention.
Figure 2:
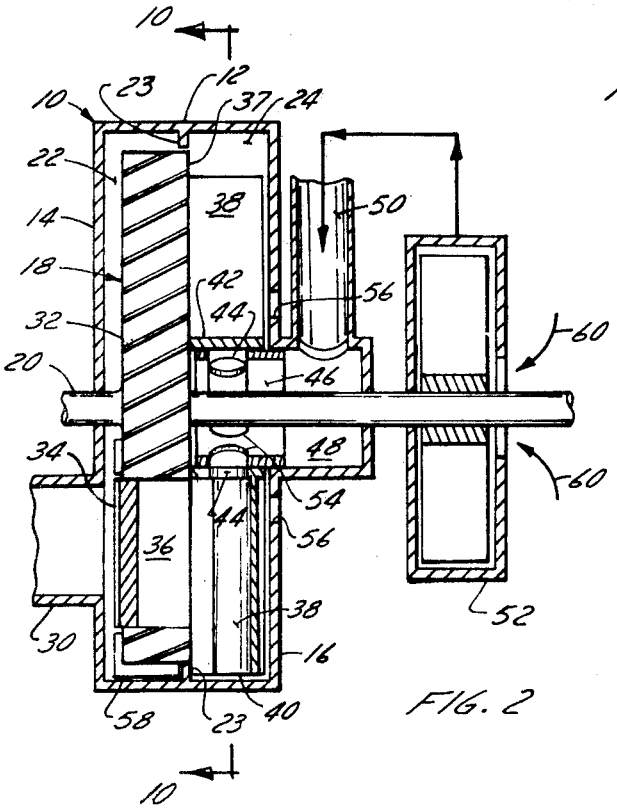
FIG. 2 is a section along the line 2—2 of FIG. 1.
Figure 4:
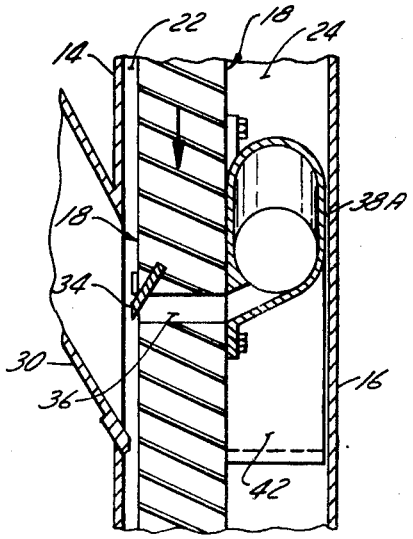

In the embodiment of FIGS. 2 to 4 positioned on the back of the disc to receive the chips passing through the disc via each slot or passage 36 is a chip compartment or pocket 38 (see also FIGS. 3 & 4). These chip pockets 38, as will be apparent from FIGS. 3 & 4 may be smaller adjacent the shaft 20 and taper so that they expand at a substantially uniform rate toward the peripheral wall. The outer edge 40 of each pocket 38 conforms with the inner periphery of the peripheral wall 12 and is positioned relatively close to this wall 12 thereby to inhibit the flow of air from the pockets 38 except through the slots 36, throughout a major portion of the rotation of the disc 18 and except when the pocket 38 is in communication with the chip outlet 28.

An angular ring 42 interconnects the narrow ends of all pockets 38. This angular ring 42 is provided with apertures 44 substantially radially communicating the inside of the ring 42 with each pocket 38 i.e. an aperture 44 is provided at the narrow end of each of the pockets 38.

Within the angular ring 42 may be mounted a valve disc 46 which is connected to a plenum chamber 48 that surround the shaft 20. The plenum chamber 48 is connected by a pipe 50 to an air compressor 52 which in the illustrated arrangement is shown driven by the shaft 20. Communication between the plenum chamber 48 and each of the pockets 38 is governed by the valve disc 46 which is cut away as indicated at 54, so that communication between the plenum 48 in each of the pockets 38 may be controlled as desired i.e. when the aperture 44 are aligned with the cut way area or areas 54.

It should be noted that in some cases the valve disc 46 may be eliminated so that the plenum 48 simply communicates directly with the inside of the angular ring 42 each of the pockets 38 is constantly in communication with the plenum 48, see particularly the FIGS. 5 to 9 embodiments. In the FIGS. 2 to 4 embodiments it is preferred to isolate each pocket 38 from the plenum 48 as the radial outlet of each pocket communicates with the chip outlet 28 by providing solid areas on the valve disc 46 at the location when each pocket is ejecting through outlet 28 (see FIG. 10).

It will be apparent from FIGS. 3 & 4 that the pocket 38 may be positioned in front of the slot 36 in the direction of movement of the disc as shown in FIG. 3 or alternatively toward the rear of each slot 36 as indicated at 38*a* in FIG. 4.

As indicated in FIG. 2, suitable apertures 56 may be provided in the rear wall 16 to permit air to be drawn in through the rear wall into the rear chamber 24 in the spaces between the pockets 38 (which will function as vanes) and facilitate the pumping of air out through chip outlet 28 thereby to aid in conveying the chips. Also it will be noted that blades or paddles 58 are provided on the disc 18 in the front chamber 22 to aid in ejecting debris through the outlet 26.

Figure 5:
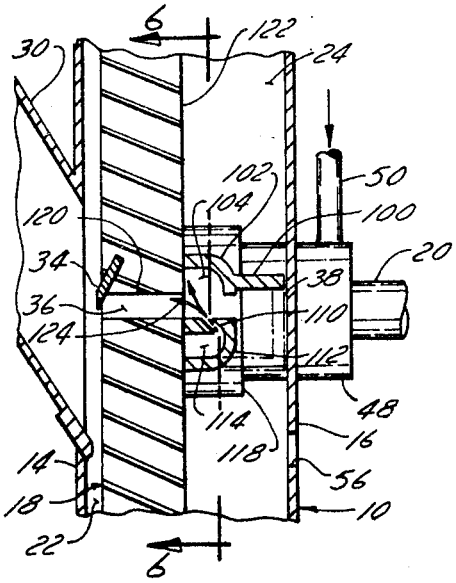
FIG. 5 is a view similar to FIGS. 3 and 4 illustrating a more sophisticated arrangement of the present invention and is a partial section along the lines 5—5 and FIG. 6.

In the embodiments shown in FIGS. 5 to 9 inclusive, the pockets 38 are optional as indicated by the dotted line in FIG. 5 and these pockets need not be connected with the source of air under pressure.

Figure 6:
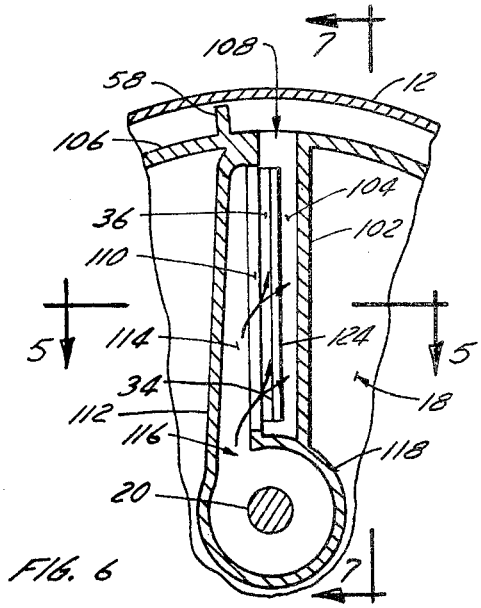
FIG. 6 is a section along the lines 6—6 of FIG. 5.
Figure 7:
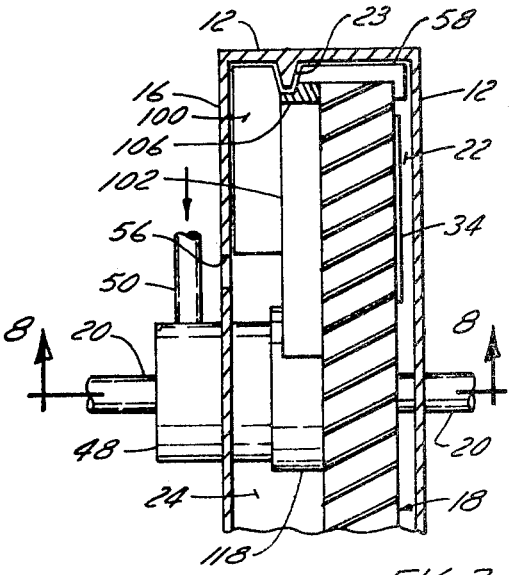
FIG. 7 is a section along the lines 7—7 of FIG. 6.
Figure 8:
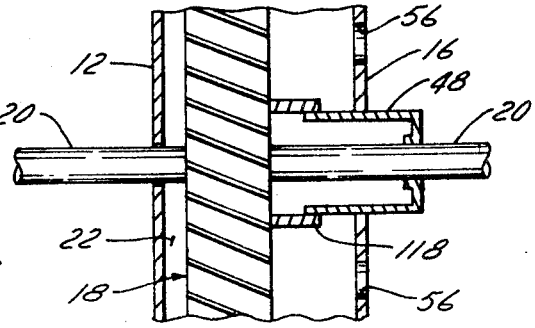
FIG. 8 is a section along the line 8—8 of FIG. 7.

Referring specifically to the embodiment illustrated in FIGS. 5 to 8 inclusive which is the more elaborate embodiment of the present invention incorporating a further separation stage for dust and fines separation subsequent to cutting of the chips. It will be noted that the pockets 38 have been replaced by paddles 100 which in the illustrated arrangement project from a structure 102 that forms a dust chamber 104 on the back side of the disc 18. Paddles 100 need not be integral with the housing 102 and could in fact be spaced therefrom rearwardly in the direction of rotation of the disc 18. As shown in FIG. 6 and 7 the structure 102 (in the illustrated arrangement only one such structure is shown, however, in a multi-knife chipper there would be one such structure for each knife) are interconnected at their outer periphery by an annular flange 106 which projects rearwardly from disc 18. The flange 106 cooperates with the partition 23 to seal the front chamber 22 from the rear chamber 24 as illustrated in FIG. 7.

Each of the dust chambers 104 communicates with the front chamber 22 via the peripheral outlet 108 which is formed through the rim 106 between the partition wall 23 and the rear face of disc 18.

A nozzle 110 is formed by an elongated slot in a duct 112 having an internal compartment 114 which communicates with the front end of chamber 48, which as above described is supplied with air from the blower 52 via pipe 50 (see FIG. 2), through the opening 116 (see FIG. 6) in the arrangement of FIGS. 5 to 9 inclusive. The front end of chamber 48 is opened ended and telescopes in sealing relation with an annular member 118 that is provided with suitable openings 116 for each duct 112 (one for each knife) on the chipper disc (only one is shown). This annular member is similar to the annular ring 42 of the FIGS. 2 to 4 embodiment, however, no valve 46 is necessary in the FIGS. 5 to 9 embodiments since the nozzle 110 functions as a metering mechanism and may be connected to the source of air pressure at all times regardless of position of the duct 112 to the outlet 28 without significantly reducing the pressure in the duct 112 as the chips are ejected through outlet 28 (if the nozzle opening 40 is not too large).

The nozzle 110 extends substantially the full length of the knife slot 36 and is aimed at the edge 129 formed between the trailing wall 120 of the chip slot 36 and the rear wall 122 (wall opposite the cutting face 35) of the disc 18. Air flow through the nozzle 110 forms a curtain across and along the length of the slot 36. The air curtain part is deflected out through the slot 36 and in part is deflected towards the dust chamber 104 when no chips are passing through the chip slot 36.

Figure 9:
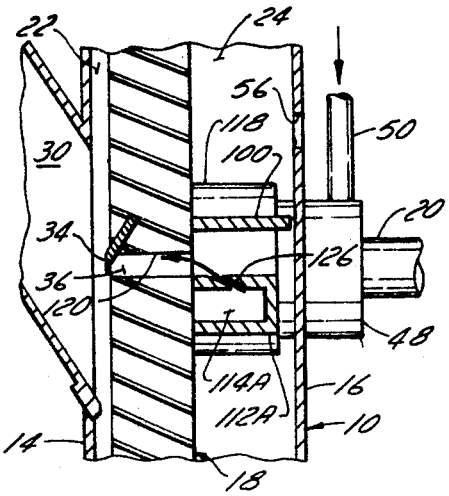
FIG. 9 is a view similar to FIG. 5 illustrating the preferred and simplest arrangement of the present invention.
Figure 10:
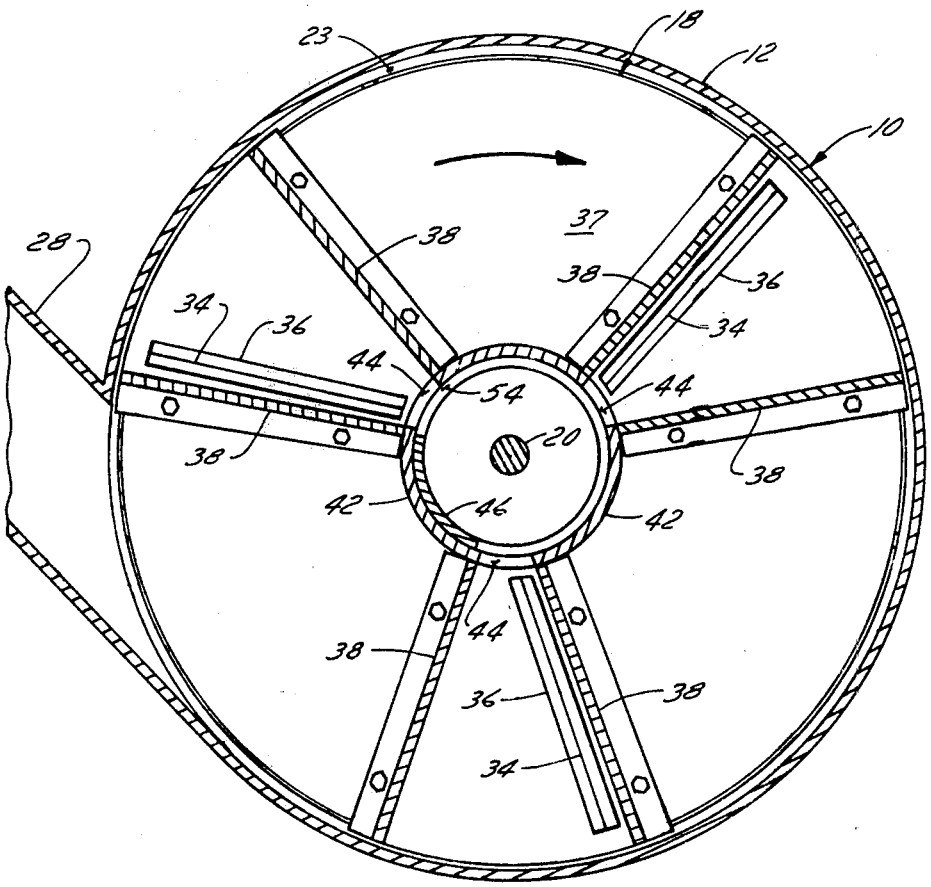
FIG. 10 is a partial section along the lines 10—10 of FIG. 2.

In the embodiment of FIG. 9 in the nozzle 110 has been replaced by a similar nozzle 126, however, since dust chamber 104 has been eliminated, this nozzle 126 (in the form of an elongated slot extending the length of the chip slot 36) is aimed to direct air as a curtain from the duct 112*a* into the slot 36 from the leading side of the slot to deflect off trailing wall 120 and into the front chamber 22. Also the duct 112*a* and this compartment 114*a* have been enlarged in a direction parallel to the axis of the disc to increase the volume and size of the opening 116 to ensure a supply of sufficient volumes of air. The duct 112 could be similarly enlarged in the FIGS. 5 to 9 embodiment.

It will be apparent that the nozzles 110 and 126 are essentially the same and that they form a curtain of the air extending across the chip slot 36. Flow could be parallel to the slot 36 i.e. not traverse it but the air nozzles would be more difficult to build and more susceptible to damage and plugging by chips.

In operation, wood is fed to the chipper in the conventional manner via the feed spout 30 and is chipped by the knives 34. The impacts of these knives against the log shake debris and like from it, particularly in whole trees chipping where a significant quantity of bark, grit, small branches and needles, leaves, etc. are present and may be separated from the tree and fall into the front chamber 22. The cut chips pass through the slots 36 into the pockets 38 or rear chamber 23 in the case of FIGS. 5 to 9.

Air is drawn into the blower 52 as indicated by the arrows 60 and is fed from the blower 52 via line 50 into the chamber 48.

In the FIGS. 2, 3 and 4 embodiment the chamber 48 communicates via the cut away section 54 and apertures 44 or directly through the apertures 44 with the pockets 38 to force air out through the slots 36 into the chamber 22. The amount of air that can escape through the outer ends (radial extremities) of the pockets 38 is limited due to the close fit between the edge 40 and the inner periphery of peripheral wall 12 of the housing 10, except when the pockets 38 are in communication with the outlet 28 and the chips and air are ejected through the outlet 28. Also in some cases (when apertures 56 are provided), air may be sucked in through the openings 56 in the back wall 18 into the spaces between the pockets 38 and blown out through the outlet 28 with the chips. Not too much air will be drawn in this way since the spaces between the pockets 38 are sealed in substantially the same manner as the pockets 38 except in the area of the outlet 28. In the event a greater air flow from between the pockets 38 is desired, rear wall 16 should be moved to increase the size of chamber 24 and provide more clearance between the pockets 38 and the rear wall and thereby permit air from between the pockets to expand and be forced out the outlet 28 during substantially the full rotation of the disc also paddles could be added in the spaces.

Debris in the front chamber 22 is ejected from the housing 10 through the outlet 26 by means of the paddles 58. The air pressure within the pockets 38 injects air through the slots 36 into the chamber 22 which significantly reduces the tendency for small duct particles leaves, needles or like debris to be entrained into the pockets 38 and remixed with chips (as would be the case in a conventional chipper not incorporating the present invention) and thereby ensuring better separation of the debris from the chips.

The operation of the FIGS. 5 to 9 embodiments is basically the same as the operation of the embodiments of FIGS. 2 to 4 inclusive. However, in the FIG. 5 to 7 arrangement, the air from the nozzle 110 when no chips are being cut deflects in part into the chip slot 36 and into the dust chamber 104. When chips are being cut they block the passage 36 i.e. when the knife 34 is cutting, much of the slot is blocked by wood and the air blown through the passage 36 into the front chamber 22 is reduced which tends to deflect the air jet issuing from the nozzle 110 towards the pocket 104. In any event, even if there is no deflection of the jet that portion of the jet split by the edge 124 and which tends to sweep through the stream of chips or around it into the chamber 104 may carry with it some of the fines and dust particles accompanying the chips thereby further cleaning the chips. The chips themselves are not deflected significantly as their inertia is too high and they travel substantially in their normal trajectory into the back chamber 24 from which they are ejected by the paddles 100.

The fines and light materials entering the dust chamber 104 move radially outward along this chamber 104 and pass through the outlet 108 at the circumference of the disc into the front chamber 22 and are ejected through the debris opening 26 by the paddles 58.

In the embodiment of FIG. 9, there is no further separation of fines and dust of the chips. Directing the air jet or curtain issuing from the nozzle 126 into the slot 136 also similar to the air ejected through the slots 36 in the 5 to 7 embodiment and significantly reduces the sucking of air in through the slot by the pumping action of the vanes 100 and thereby reduces any tendency for material to be entrained through the slots and contaminate the chips is essentially eliminated.

The air flow through the slots 35 should be at the speed of at least about 1000 ft/min to clear light materials in the debris chamber from in front of the knife and preferably above about 5000 ft/min. In the embodiments of FIGS. 5 to 9 the width of the nozzle should be at least about ¼ inch and preferably above ½ inch and the pressure within the duct 112 be at least about 5 inches of water and preferably above 10 inches for low pressure operation. If higher pressures are used smaller nozzles may be used but this requires more sophisticated blowers.

Only substantially radial introduction of air into the compartments 38, **38*a*, 114, or 114*a* have been shown in the drawings i.e. via an axial passage 48, however, other modes of air introduction may be used. For example in the FIG. 1 to 4 embodiments a plenum chamber could be provided behind the rear wall 16 of the housing and the rear wall be provided with a slot equivalent to the slot 54 adapted to communicate with the pockets 38 through suitable holes in the rear wall of the pockets 38 positioned in alignement with the slot. This construction would require some form of slot sealing means mounted on the disc 18 (such as a radial wall) between the holes leading into circumferentially adjacent pockets. Changes in the angular velocity of the disc obviously changes the speed of the chips, debris, etc. as well as the centrifulgal force which effects the air flows in all of the embodiments of the invention. As the angular velocity of the disc increases, the air flow to the chip chamber or through the nozzles may require appropriate adjustment. The embodiment of FIGS. 5 and 6 is further effected by an increase in the angular velocity of the disc as the speed at which the chips traverse the opening to the dust chamber 104** increases and the time available to separate dust is reduced to the extent that at higher velocity significant dust separation may not be attainable at practical air pressures.

The angular velocity together with the perameters of the equipment contributes significantly to the pumping or blower action of the chip pockets and if too much air is blown from the chip pockets by the fan action of the rotating disc exhilarating air should be introduced into these chip chambers.

The term "disc" in relation to the chipper rotor as used herein in intended to include discs with a planer (radial) cutting face as well as those with conical cutting faces including rotors formed by a pair of conical discs combined to form what is sometimes referred to in the trade as a V-drum chipper.

Modifications will be evident to those skilled in the art without departing from the spirit of the invention as defined on the appended claims.

I claim:

1. A debris separating chipper comprising; a disc, means for mounting said disc for rotation around an axis, a cutting face on said disc, at least one knife mounted on said cutting face, a housing for said disc, a debris chamber in said housing, said cutting face forming one wall of said debris chamber, a chip slot through said cutting face leading to a chip space, compartment on said disc communicating with said slot, means for connecting said compartment to a means for providing air under pressure so as to eject air from said compartment through said clip slot into said debris chamber, a chip outlet from said chipper communicating with said space and a debris outlet from said chipper for ejecting debris from said debris chamber.

2. A chipper as defined in claim 1 wherein said compartment comprises a chip pocket surrounding said slot, said pocket having its outlet end in close proximity to a peripheral wall of said housing except when said pocket is in communication with said chip outlet thereby air pressure is maintained in said pocket so that air will flow out through said clip slot during a major portion of a rotation of said rotor.

3. A chipper is defined in claim 1 wherein said compartment comprises a duct having nozzle means extending substantially along said chip slot, said nozzle being aimed to direct air from said nozzle means as an air curtain through said slot toward said debris chamber.

4. A chipper defined in claim 3 wherein said nozzle extends the full length of said chip slot.

5. A chipper as defined in claim 4 wherein said nozzle is aimed to direct air as a curtain across said slot from the side of said slot leading in the direction of rotation of said disc to the trailing side of said slot.

6. A chipper as defined in claims 4 or 5 wherein said nozzle means is positioned in front of said slot in the direction of rotation of said disc and is aimed at the intersection between a trailing wall of said chip slot and a wall of said rotor opposite said cutting face and further comprising means forming a dust chamber immediately adjacent said intersection and positioned to receive fines and dust material deflected by said air jet while permitting chips to pass thereby an outlet from said dust chamber communicating with said debris chamber.

7. A chipper as defined in claim 4 further comprising paddle means in said debris chamber for forcing debris out of said debris chamber to said debris outlet.

8. A chipper as defined in claims 1, 2, or 3 further comprising paddle means in said debris chamber for forcing debris out of said debris chamber to said debris outlet.

9. A chipper as defined in claim 1 wherein said compartment comprises an air passage, nozzle means communicating with said air passage, said nozzle means extending a significant distance along said slot and being aimed to direct air from said nozzle means through said slot toward said debris chamber.

* * * * *